US009273591B2

(12) United States Patent
DiPaola et al.

(10) Patent No.: US 9,273,591 B2
(45) **Date of Patent: *Mar. 1, 2016**

(54) VEHICLE COOLING SYSTEM WITH DIRECTED FLOWS

(71) Applicant: Magna Powertrain Inc., Troy, MI (US)

(72) Inventors: Pasquale DiPaola, Maple (CA); Malcolm J. Clough, Pembroke (CA); Robert Scotchmer, Toronto (CA)

(73) Assignee: Magna Powertrain Inc., Concord (CA)

( * ) Notice: Subject to any disclaimer, the term of this patent is extended or adjusted under 35 U.S.C. 154(b) by 268 days.

This patent is subject to a terminal disclaimer.

(21) Appl. No.: 13/920,332

(22) Filed: Jun. 18, 2013

(65) Prior Publication Data

US 2013/0276727 A1 Oct. 24, 2013

Related U.S. Application Data

(63) Continuation of application No. 13/453,611, filed on Apr. 23, 2012, now Pat. No. 8,464,668, which is a continuation of application No. 12/299,804, filed as application No. PCT/CA2007/000798 on May 8, 2007, now Pat. No. 8,181,610.

(60) Provisional application No. 60/746,709, filed on May 8, 2006.

(51) Int. Cl.

| | |
|---|---|
| ***F01P 7/14*** | (2006.01) |
| ***F01P 7/16*** | (2006.01) |
| *F01P 11/02* | (2006.01) |
| *F01P 11/08* | (2006.01) |
| *F01P 3/02* | (2006.01) |

(52) U.S. Cl.

CPC . *F01P 7/16* (2013.01); *F01P 7/165* (2013.01); *F01P 11/028* (2013.01); *F01P 11/08* (2013.01); *F01P 2003/027* (2013.01); *F01P 2060/08* (2013.01); *F01P 2070/04* (2013.01); *Y10T 137/2617* (2015.04)

(58) Field of Classification Search

CPC ..... F01P 7/165; F02M 25/1796; Y10T 137/86726; Y10T 137/0502; F16K 27/0263

USPC ..... 123/41.1; 137/115.6, 115.16; 251/51

See application file for complete search history.

(56) References Cited

U.S. PATENT DOCUMENTS

| | | | | |
|---|---|---|---|---|
| 5,551,480 A * | 9/1996 | Tomatsu | B60H 1/00485 | 137/625.29 |
| 6,109,218 A * | 8/2000 | Bachschmid | F01P 7/165 | 123/41.08 |
| 6,364,213 B1 * | 4/2002 | Baltz | F01P 7/16 | 123/41.01 |

(Continued)

*Primary Examiner* — Marguerite McMahon
*Assistant Examiner* — James Kim
(74) *Attorney, Agent, or Firm* — Dickinson Wright PLLC

(57) ABSTRACT

A cooling system for internal combustion engines provides directed flows of heated or cooled coolant to various engine components and/or accessories as needed. By providing directed flows, the overall coolant flow volume is reduced from that of conventional cooling systems, allowing for a smaller capacity water pump to be employed which results in a net energy savings for the engine. Further, by reducing the overall coolant flow volume, the hoses and/or galleries required for the directed flows are reduced from those of conventional cooling systems, providing a cost savings and a weight savings. Finally, by preferably employing an impellor type water pump, the expense of an electric water pump and its associated control circuitry can be avoided. The direct flows are established by a multifunction valve which, in a preferred implementation, comprises a two-plate valve wherein each plate is operated by a wax motor.

19 Claims, 6 Drawing Sheets

(56) References Cited

U.S. PATENT DOCUMENTS 7,096,831 B2 * 8/2006 Finkbeiner ..... F01P 7/16 123/41.1
7,263,954 B2 * 9/2007 Piddock et al. ..... 123/41.09
8,464,668 B2 * 6/2013 DiPaola et al. ..... 123/41.1
2004/0216701 A1 * 11/2004 Hutchins ..... F01P 7/16 123/41.08

* cited by examiner

VEHICLE COOLING SYSTEM WITH DIRECTED FLOWS

CROSS-REFERENCE TO RELATED APPLICATIONS

This application is a continuation of U.S. patent application Ser. No. 13/453,611, filed on Apr. 23, 2012 (now U.S. Pat. No. 8,464,668) which is a continuation of U.S. patent application Ser. No. 12/299,804, filed on Mar. 31, 2009 (now U.S. Pat. No. 8,181,610) which is a National Stage of International Application No. PCT/CA2007/000798, filed May 8, 2007, which claims the benefit of U.S. Provisional Application No. 60,746,709, filed May 8, 2006. The entire disclosures of each of the above applications are incorporated herein by reference.

FIELD

The present invention relates to cooling internal combustion engines. More specifically, the present invention relates to cooling systems for internal combustion engines in vehicles.

BACKGROUND

Cooling systems for internal combustion engines in vehicles typically comprise a water jacket and various galleries in the internal combustion engine through which coolant, typically a mixture of water and ethylene glycol, is circulated. The coolant is heated by the engine and averages temperatures in the engine (which would otherwise vary significantly from place to place) and is then passed through a heat exchanger to dissipate waste heat to the surrounding atmosphere. After rejecting some heat through the heat exchanger, the coolant is returned to the engine for another cycle.

In addition to the water jacket, galleries and heat exchanger (typically in the form of a radiator), modern cooling systems often include a variety of other components such as heater cores, which are supplied with heated coolant to warm the interior of the vehicle, and lubrication oil and/or transmission oil coolers which are used to remove heat from the oils to enhance their operating lifetimes and/or performance.

Conventionally, these cooling systems typically consisted of one or two loops through which the coolant circulated with minimal control, other than a thermostat, which restricted the flow of coolant through the radiator until the engine had reached a desired operating temperature, and a control valve which would enable or disable the flow of coolant to the heater core depending upon whether it was desired to supply heat to the interior of the vehicle.

More sophisticated cooling systems, such as that taught in U.S. Pat. No. 6,668,764 to Henderson et al. have been proposed. The Henderson system is intended for use with diesel engines and employs a multiport valve in conjunction with an electrically operated coolant pump to provide a cooling system with several coolant circulation loops. By positioning the multiport valve in different positions and operating the electric water pump at different speeds/capacities, different functions can be performed by the cooling system. For example, at engine start up in cold ambient temperatures, all coolant flow through the engine can be inhibited. Once a minimum engine temperature is achieved, a flow of coolant can be provided to a passenger compartment heater core. Once a higher engine operating temperature has been achieved, or a specified temp has been exceeded, a flow of coolant can be provided to a lubrication oil heater core to assist the lubrication oil in achieving a desired minimum operating temperature, etc.

While the cooling system taught in Henderson provides operating advantages, it still suffers from some disadvantages in that it requires an electrically operated coolant pump with a relatively high capacity to meet worst case cooling conditions. In zero flow, or restricted flow, conditions the electric coolant pump must be electrically shut down as such pumps typically cannot be operated under zero flow conditions without damaging the pump. Further, such pumps are more expensive to manufacture, control and maintain than are mechanical coolant pumps and can be more subject to failures. Further, the cooling system taught in Henderson requires both a lubrication oil cooling heat exchanger and a lubrication oil heating heat exchanger to be able to raise the temperature of the lubricating oil of the engine to a desired minimum operating temperature and to then assist in cooling the lubricating oil.

It is desired to have a cooling system which provides for more sophisticated heating and cooling strategies without requiring electrically operated coolant circulation pumps or other expensive components.

SUMMARY

It is an object of the present invention to provide a novel coolant system for internal combustion engines which obviates or mitigates at least one disadvantage of the prior art.

According to a first aspect of the present invention, there is provided a circulating coolant cooling system for an internal combustion engine, comprising: a multifunction valve having a plurality of input ports and output ports; a radiator connected between one of said inlet ports and one of said outlet parts; a pump for pumping coolant, the pump connected between one of said inlet ports and one of said outlet parts; a water jacket in the engine block, the water jacket connected between one of said inlet ports and one of said outlet parts; a water jacket in the engine cylinder head, the water jacket connected between one of said inlet ports and one of said outlet parts; a heater core for a heater in a passenger compartment, the heater core connected between one of said inlet ports and one of said outlet parts; a degas bottle to capture and retain gases entrapped in the coolant, the degas bottle connected between one of said inlet ports and one of said outlet parts; and a heat exchanger for heating or cooling lubricating oil of the engine, the heat exchanger connected between one of said inlet ports and one of said outlet parts and wherein the multifunction valve interconnects the engine and cooling system components operates to permit and inhibit direct flows of coolant as necessary for thermal management of the engine.

Preferably, in a first mode, the multifunction valve inhibits coolant flows in said cooling system, and in a second mode, the multifunction valve permits the flow of coolant from the water pump to the water jacket in the engine cylinder head, through the multifunction valve, and to the heater core. Also preferably, in a third mode, the multifunction valve also permits the flow of coolant from the water pump to the water jacket in the engine block and through the heat exchanger for the engine lubricating oil and, in a fourth mode, the multifunction valve also permits a flow of heated coolant through the degas bottle. Also preferably, in a fifth mode, the multifunction valve also permits the flow of heated coolant through the radiator and a inhibits the flow of heated coolant through the heat exchanger for the engine lubricating oil and permits a flow of cooled coolant through the heat exchanger for the engine lubricating oil, and in a sixth mode, the multifunction valve inhibits the flow of coolant through the heater core.

Also preferably, additional or different cooling circuits/devices, if desired, can be provided with directed flows of coolant with the present invention.

The present invention provides an improved cooling system for internal combustion engines. The cooling system provides directed flows of heated or cooled coolant to various engine components and/or accessories as needed. By providing directed flows, the overall coolant flow volume is reduced from that of conventional cooling systems, allowing for a smaller capacity water pump to be employed which results in a net energy savings for the engine. Further, by reducing the overall coolant flow volume, the hoses and/or galleries required for the directed flows are reduced from those of conventional cooling systems, providing a cost savings and a weight savings. Finally, by preferably employing a mechanically driven impellor type water pump, the expense of an electric water pump and its associated control circuitry can be avoided. The direct flows are established by a multifunction valve which, in a preferred implementation, comprises a two-plate valve wherein each plate is operated by a wax motor, although other valve system and/or actuators, as will occur to those of skill in the art, can also be employed.

DRAWINGS

Preferred embodiments of the present invention will now be described, by way of example only, with reference to the attached Figures, wherein.

DETAILED DESCRIPTION

Figure 1:
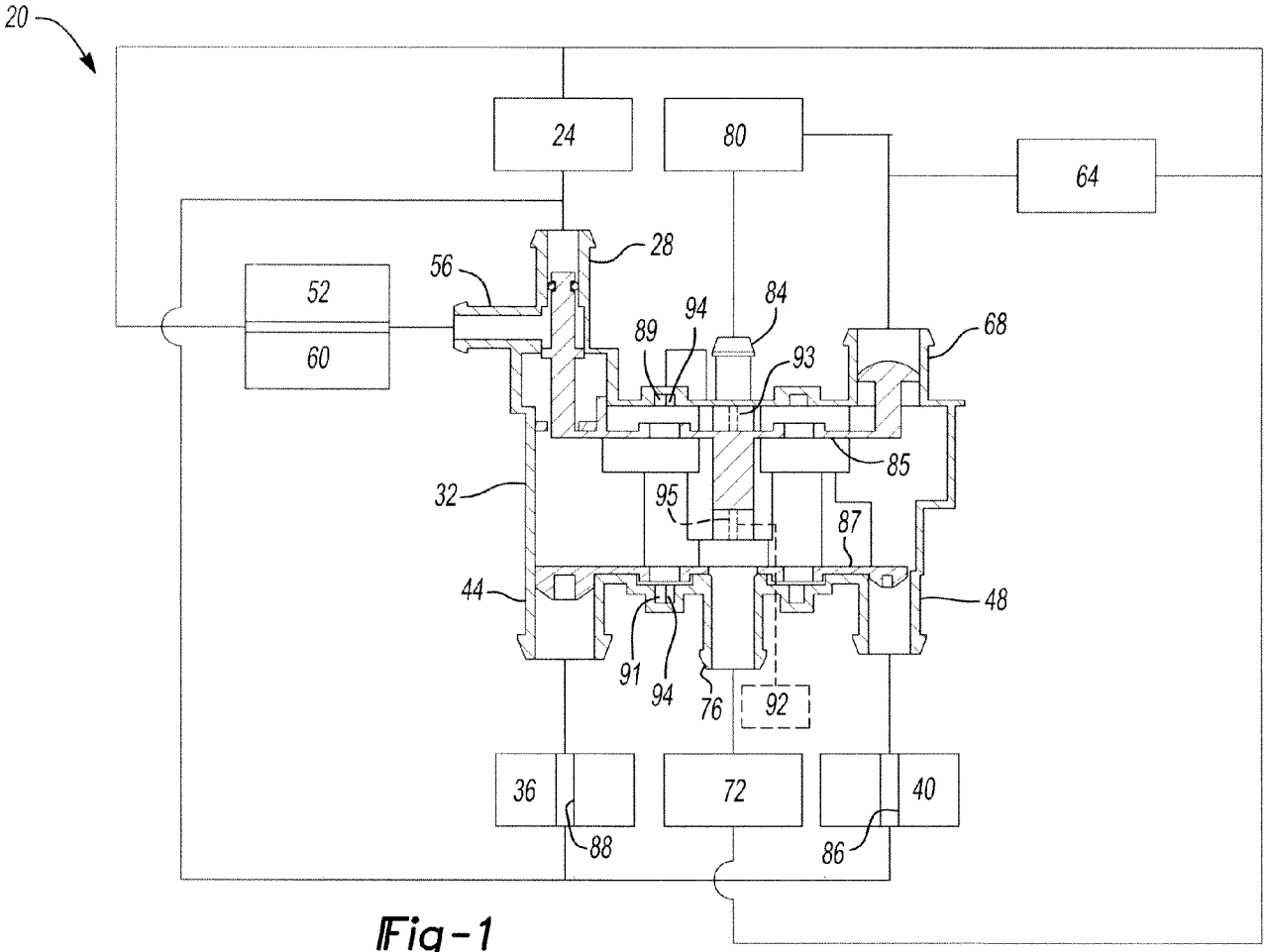
FIG. 1 shows a schematic representation of a cooling system in accordance with the present invention, the cooling system being in a first mode.

A cooling system in accordance with the present invention is indicated generally at 20 in FIGS. 1 through 6. Cooling system 20 comprises a water pump 24, which in a present embodiment of the invention is a mechanical, impeller type, water pump whose output is somewhat less than the output required from a water pump in a conventional cooling system for an equivalent sized engine. For example, if a conventional cooling system requires a water pump with an output of 4.7 liters per second at an engine speed of 7700 RPM, it is contemplated that water pump 24 can have an output of about 2.75 liters per second at 7700 RPM as with the directed flows of coolant of the present invention, as described in more detail below, a reduced flow rate (volume) of coolant can be employed, resulting in an overall energy savings for the engine with the coolant system. In the particular example discussed herein, the reduction in the required flow of coolant results in an energy savings of approximately 1.37 kW (or almost two horsepower) with a commensurate improvement in fuel economy and/or engine performance.

The output of water pump 24 is connected to both an inlet port 28 on a multifunctional valve 32, described in more detail below, and to the engine block 36 and cylinder head 40 of the engine. While it is preferred that coolant be separately circulated through engine block 36 and cylinder head 40, this is not a limitation of the present invention and the present invention can be employed with engines with a conventional integrated cooling jacket, albeit with a reduced cooling system efficiency.

The coolant outlet of engine block 36 is connected to an inlet port 44 of valve 32 and the coolant outlet of cylinder head 40 is connected to another inlet port 48 of valve 32.

An engine oil heat exchanger 52, which can operate to heat or cool engine oil is connected to an outlet port 56 of multifunction valve 32, as is a transmission oil heat exchanger 60 which can operate to heat or cool transmission oil. While not illustrated, it is contemplated that engine oil heat exchanger 52 and transmission oil heat exchanger 60 can instead be configured as separate directed flows if desired and, in this case, transmission oil heat exchanger 60 will be connected to another outlet port, not shown, on multifunction valve 32. The coolant outlets of engine oil heat exchanger 52 and transmission oil heat exchanger 60 are connected to the inlet of water pump 24 (as shown) or can alternatively be connected to (not shown) the inlet side of a radiator 64.

The inlet of radiator 64 is connected to an outlet port 68 of valve 32 and the outlet of radiator 64 is connected to the inlet of water pump 24 and to a passenger compartment heater core 72 and the outlet of heater core 72 is connected to an inlet port 76 of valve 32.

A coolant degas bottle 80 is also connected to outlet port 68 and is further connected to an inlet port 84 of valve 32 and degas bottle 80 operates to remove entrapped gasses from the coolant circulating through system 20. While in the illustrated embodiment degas bottle 80 is illustrated as a separate component, in some coolant systems the degas bottle comprises an end tank on the radiator and such systems are intended to fall within the term degas bottle, as used herein.

Multifunction valve 32 operates, as described below, to appropriately direct flows of coolant through various components of cooling system 20 as needed. In a present embodiment of the invention, multifunction valve 32 includes two plates 85, 87 which move to open, close and interconnect the inlet and outlet ports of valve 32 to permit or inhibit the flows of coolant. In the present embodiment, the plates 85, 87 of valve 32 are operated by a wax motor, although any other suitable operating mechanism can be employed, as described below.

Wax motors comprise wax filled cylinders with moveable pistons mounted therein such that, when heated, the wax expands extending the piston to operate a device such as the plates of valve 32. When cooled, the wax contracts, either drawing the piston back into the cylinder (and retracting the valve plate) or allowing the piston to be urged back into the cylinder by a biasing spring. Wax motors are commonly used in thermostats for cooling systems, amongst other uses, and can be directly controlled by the temperature of the coolant and can also be electronically controlled by operating an electric heater adjacent the cylinder to heat the wax in the absence of sufficient temperature of the coolant.

In the preferred embodiment of the present invention, the wax motors 89, 91 operating the plates 85, 87 in valve 32 are immersed in the coolant and are also equipped with an electric heater 94 to allow the operation of the plates to be electrically overridden if desired.

While the present embodiment employs a dual plate, wax motor operated valve as multifunction valve 32, it will be apparent to those of skill in the art that the present invention is not so limited and any suitable valve mechanism can be employed as desired and any suitable operating mechanism, including microprocessor controlled electronic valves or an electric motor 92 with gear driver for two threaded shafts 93, 95 that rotate and in turn allow the valve plates to move relative to each other via threaded components integrated into each plate. The alternative electric motor 92 and shafts 93, 95 are shown in hidden line representation.

As mentioned above, in the present invention directed flows of coolant are provided or inhibited to various cooling system components as required. In FIG. 1, system 20 is shown in a start up configuration, for cooler ambient temperatures wherein no coolant flows are provided and water pump 24 is effectively deadheaded.

Figure 2:
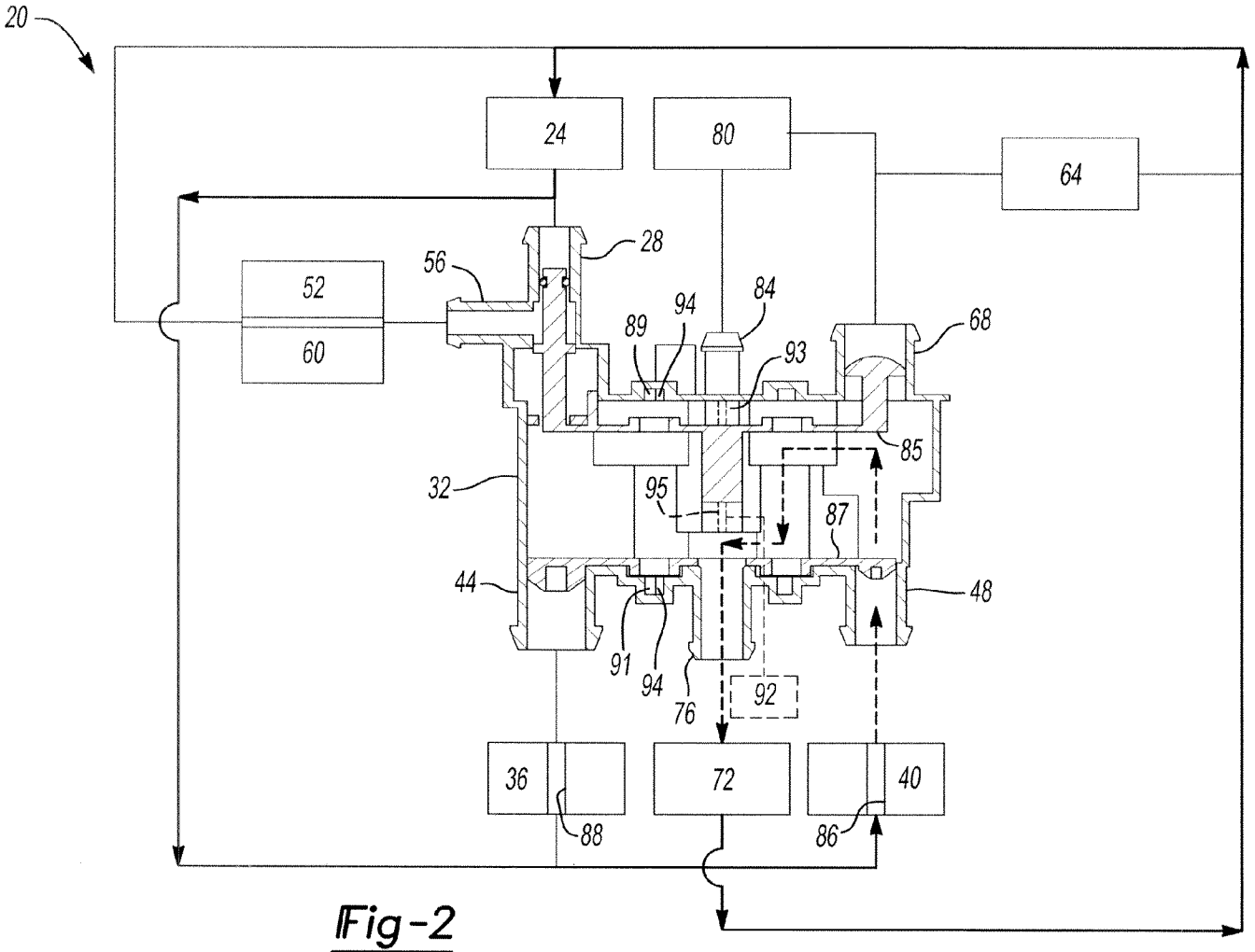
FIG. 2 shows a schematic representation of a cooling system in accordance with the present invention, the cooling system being in a second mode.

After the engine is started and the cylinder head 40 begins to warm, valve 32 connects inlet port 48 to outlet port 76. This results, as shown in FIG. 2, in a directed flow of coolant from water pump 24 to a water jacket 86 of cylinder head 40, where it is heated, and then through heater core 72, to permit warming of the passenger compartment of the vehicle and then back to the inlet of water pump 24. In FIG. 2, the flow of cool coolant is indicated in solid medium-weight line while the flow of hot coolant (between cylinder head 40 and heater core 72) is indicated in dashed heavy line, while coolant paths with no flow of coolant are indicated in thin line.

Figure 3:
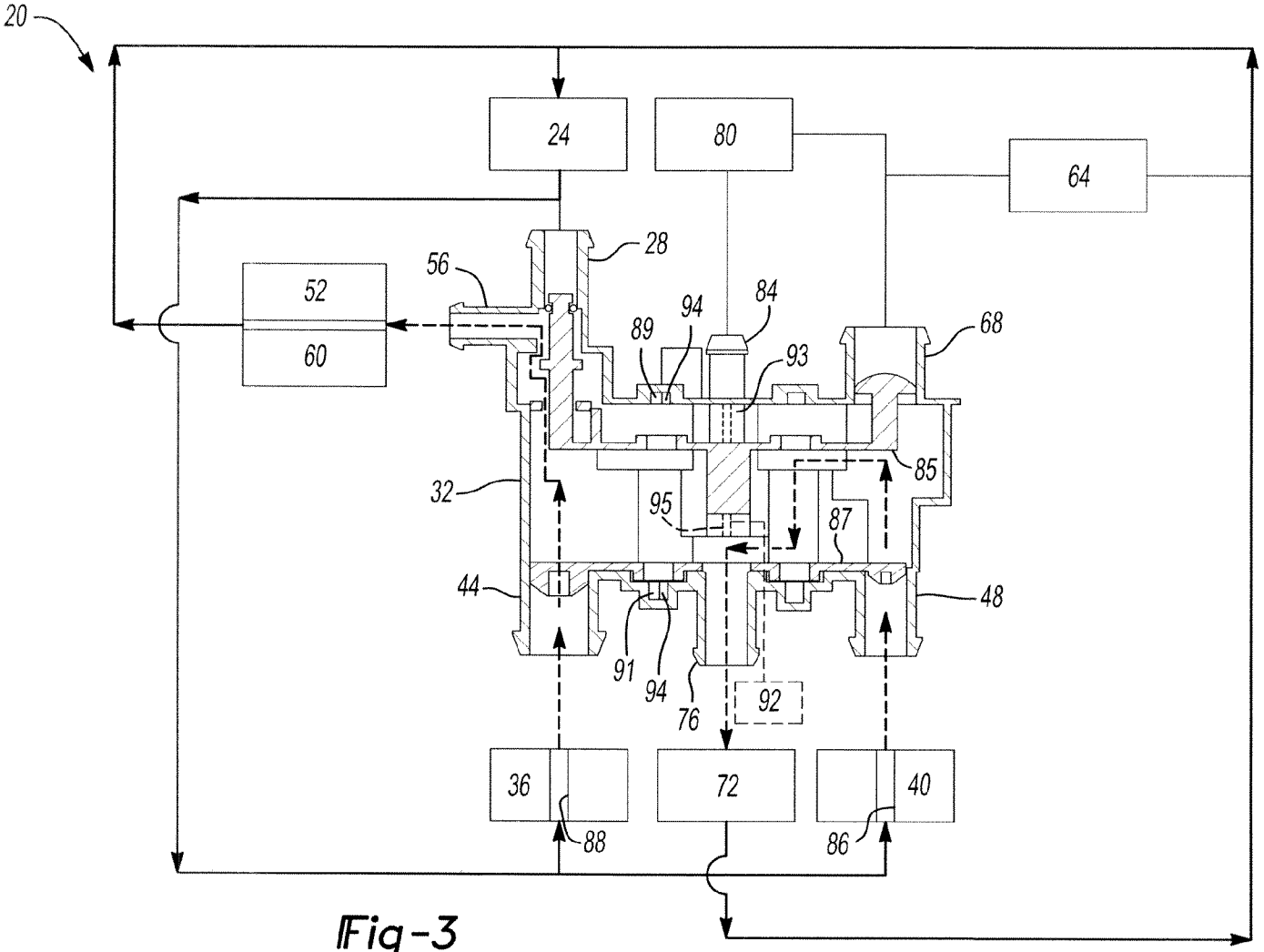
FIG. 3 shows a schematic representation of a cooling system in accordance with the present invention, the cooling system being in a third mode.

As illustrated in FIG. 3, as the engine continues to warm, a further directed flow is created when valve 32 connects inlet port 44 to outlet port 56 also directing coolant from water pump 24 through a water jacket 88 of engine block 36, where it is warmed, and through engine oil heat exchanger 52 and transmission oil heat exchanger 60, where the warm coolant heats the oils and is, in turn, cooled, and then returns back to the inlet of water pump 24. As before, the flows of cool coolant are indicated in solid medium-weight line while the flows of hot coolant are indicated in dashed heavy line. Water jacket 88 is separate from water jacket 86.

By providing a directed flow of coolant to heater core 72, virtually any desired coolant flow rate can be achieved through heater core 72 in contrast to conventional bypass designs. Therefore, if desired, any flow rate up to the entire capacity of water pump 24 can be provided to heater core 72 for increased passenger comfort.

Figure 4:
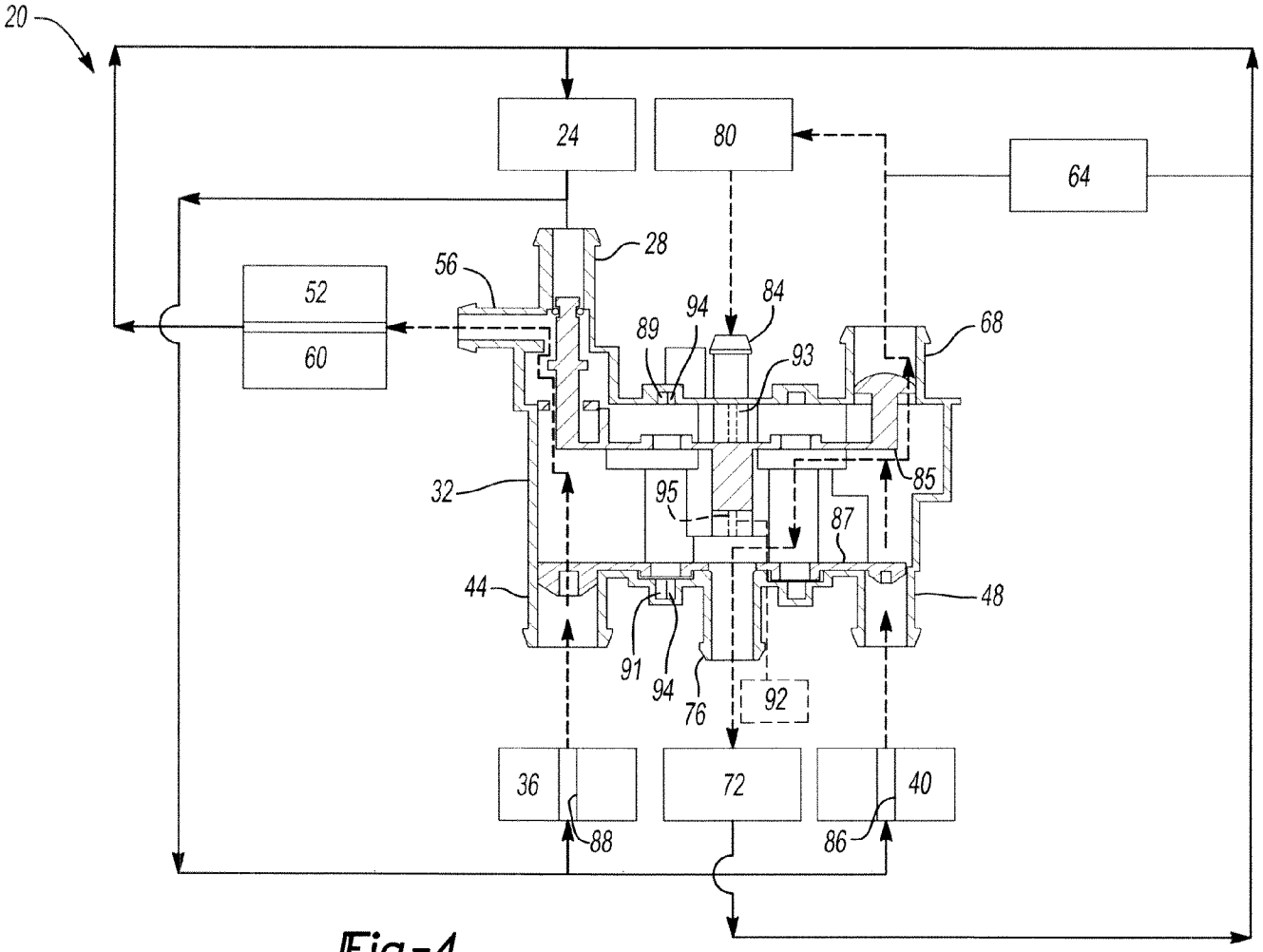
FIG. 4 shows a schematic representation of a cooling system in accordance with the present invention, the cooling system being in a fourth mode.

FIG. 4 shows the next directed flow which occurs, as the engine warms to approach its expected operating temperature. As shown, valve 32 partially opens outlet port 68 to allow flow of heated coolant through degas bottle 80 to inlet port 84, which is also now open, and then to heater core 72. As the degas bottle 80 typically contains some volume of coolant, in the present invention circulation of coolant through degas bottle 80 is inhibited until this point to allow the other directed flows to make any needed use of warmed coolant.

One of the advantages of the present invention is that multifunction valve 32 can modulate flows of coolant between maximum and minimum flow rates as desired, unlike prior art systems wherein the flows were either enabled or inhibited.

Figure 5:
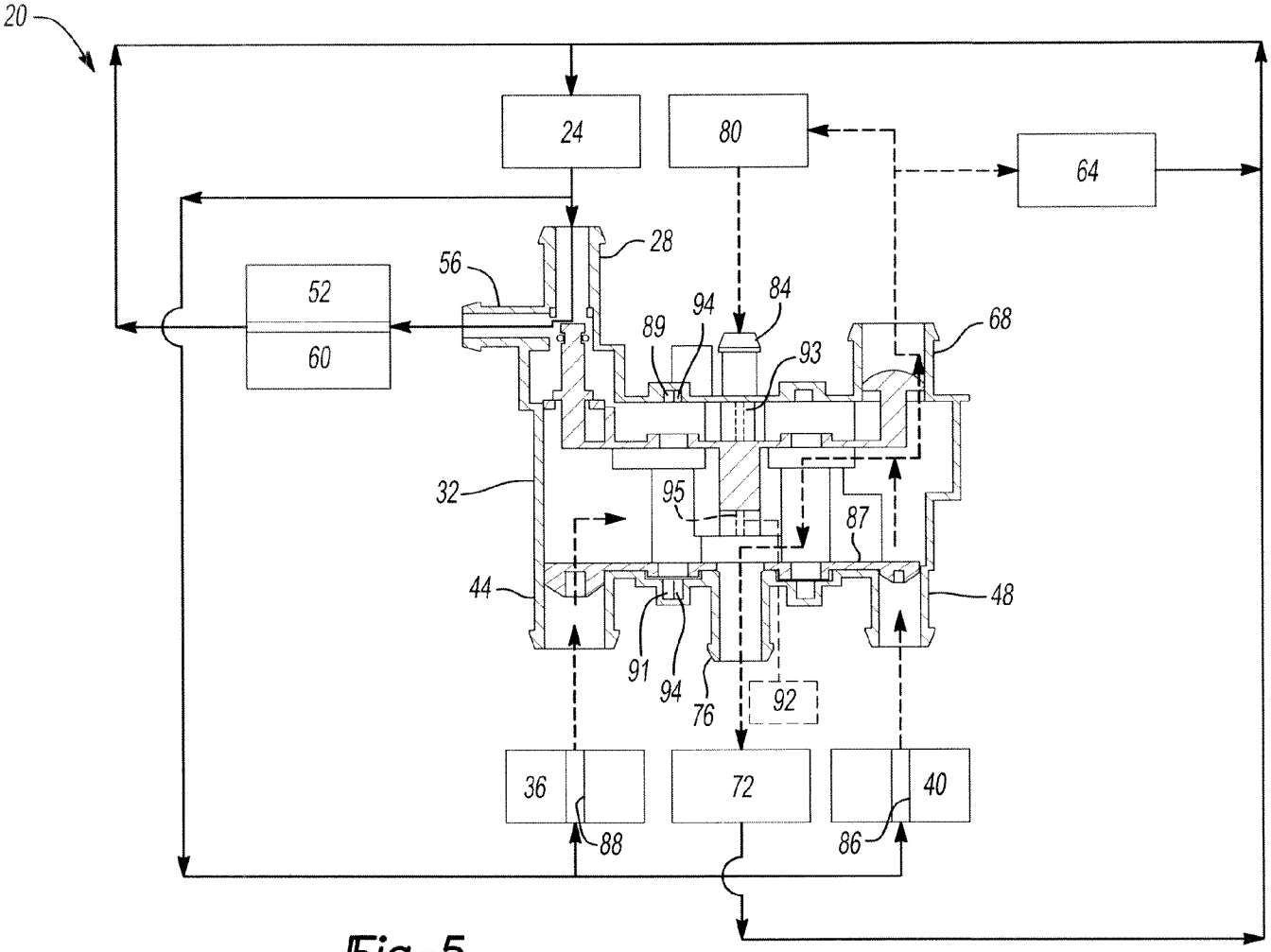
FIG. 5 shows a schematic representation of a cooling system in accordance with the present invention, the cooling system being in a fifth mode.
Figure 6:
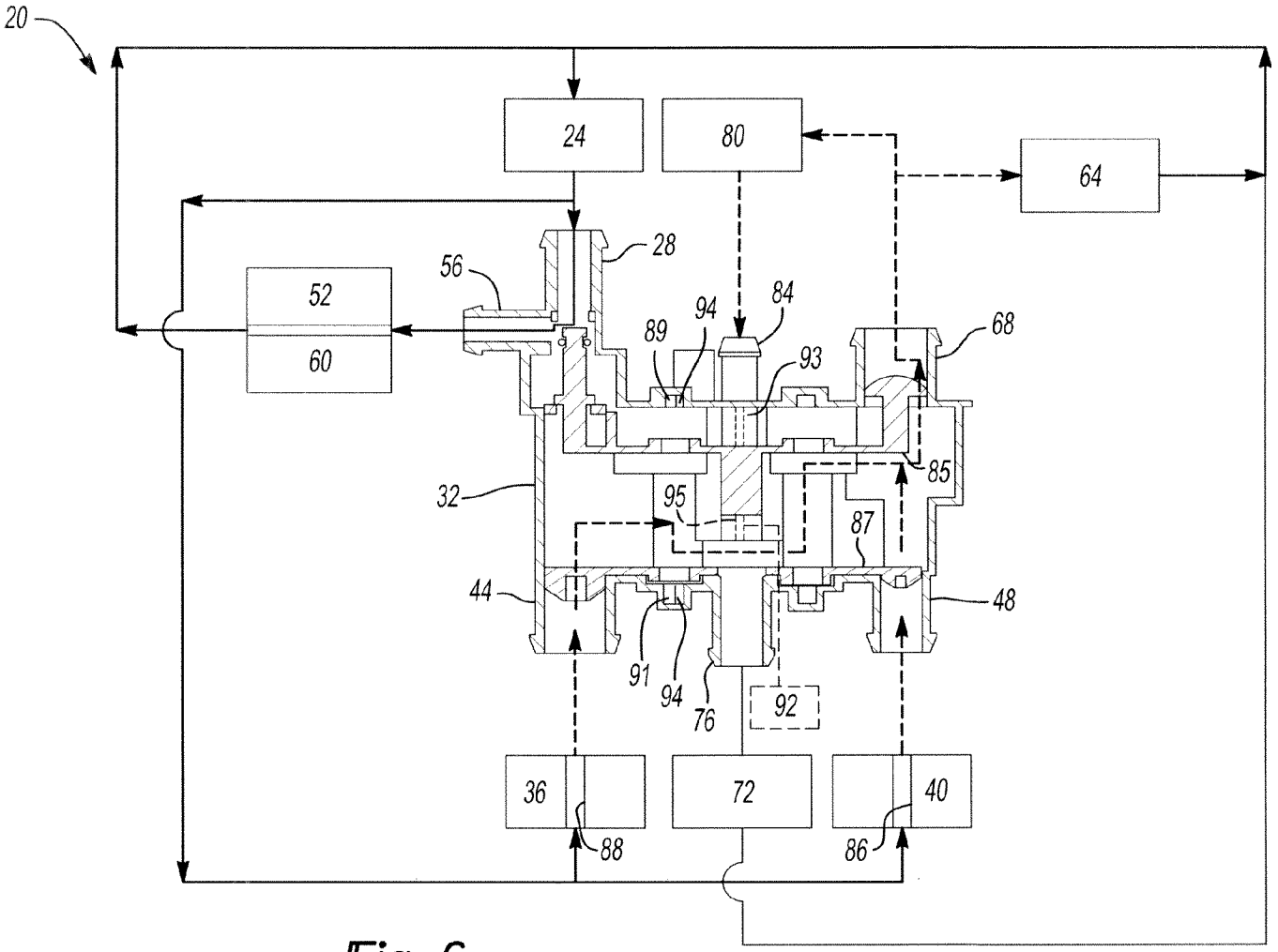
FIG. 6 shows a schematic representation of a cooling system in accordance with the present invention, the cooling system being in a sixth mode.

As the engine achieves its normal expected operating temperature, valve 32 fully opens outlet port 68 as shown in FIG. 5 to allow coolant heated by cylinder head 40 and engine block 36 to flow through radiator 64 where it is cooled and returned to the inlet of water pump 24. Also, inlet port 28 is opened and outlet port 56 is connected to it, rather than to inlet port 44, such that cool coolant is supplied to engine oil heat exchanger 52 and to transmission oil heat exchanger 60 to commence oil cooling.

If the operating temperature of the engine begins to approach an upper level of its permitted range, system 20 can be configured to close outlet port 76, stopping coolant flow through heater core 72 and instead adding that coolant flow to the coolant flow passing through radiator 64.

By directing separate flows of coolant, as necessary and/or appropriate, for different operating conditions of the engine, better thermal management of the engine can be achieved. Further, because the directed flows are sized for the particular heat transfer needs, the hoses and galleries for the flows are generally smaller than those needed for conventional cooling systems wherein one, or perhaps two, flows encompass all of the circulating coolant.

Also, water pump 24 can be smaller than the water pumps used in conventional cooling systems as the total coolant flow volume through system 20 can be smaller than the flow volumes through conventional cooling systems. Also, as water pump 24 is preferably an impellor type pump driven by the engine, the extra expense of the electric water pump, required by other cooling systems, can be avoided as water pump 24 can be deadheaded when no flow is required.

Another advantage of the present invention over other cooling systems is that separate heat exchangers are not required to heat and cool the engine oil as the appropriate flow of either heated coolant or cooled coolant can be provided to heat exchanger 52 to either heat or cool the engine lubricating oil, as required. Similarly, separate heat exchangers are not required to heat and cool the transmission oil as the appropriate flow of either heated coolant or cooled coolant can be provided to heat exchanger 60 to either heat or cool the engine lubricating oil, as required.

While the description above only discusses radiators, heater cores, degas bottles, cylinder heads, engine blocks and heat exchangers for lubrication oil and/or transmission oil, the present invention is not so limited and any additional, or alternative, coolant circuits/devices can also be employed with the present invention. For example, throttle body heaters, EGR valve coolers, fuel heating heat exchangers, additional heater cores, brake system coolers or any other coolant device can be provided with an appropriate direct flow of coolant.

As will now be apparent, the present invention provides an improved cooling system for internal combustion engines. The cooling system provides directed flows of heated or cooled coolant to various engine components and/or accessories as needed. By providing directed flows, the overall coolant flow volume is reduced from that of conventional cooling systems, allowing for a smaller capacity water pump to be employed which results in a net energy savings for the engine. Further, by reducing the overall coolant flow volume, the hoses and/or galleries required for the directed flows are reduced from those of conventional cooling systems, providing a cost savings and a weight savings. The resulting reduced overall flow rate requirements and/or smaller water pump results in an energy savings compared to conventional cooling systems. Also, by inhibiting the flow of coolant during start up conditions, the engine can achieve desired operating temperatures more quickly, allowing for reduced emissions and enhanced fuel economy. Finally, by preferably employing a mechanically driven impellor type water pump, the expense of an electric water pump and its associated control circuitry can be avoided. The direct flows are established by a multifunction valve which, in a preferred implementation, comprises a two-plate valve wherein each plate is operated by a wax motor or by any suitable electric motor and control system.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A circulating coolant cooling system for an internal combustion engine, comprising:

a multifunction valve having a plurality of inlet ports and outlet ports, a first moveable plate, a second moveable plate, and an operator for moving the plates to selectively open and close passageways interconnecting the inlet and outlet ports, the first moveable plate selectively restricting and unrestricting fluid flow through a first one of the plurality of inlet ports and first and second ones of the plurality of outlet ports, the second moveable plate selectively restricting and unrestricting fluid flow through second and third ones of the plurality of inlet ports;

a radiator connected between one of said inlet ports and one of said outlet ports;

a pump for pumping coolant, the pump connected between one of said inlet ports and one of said outlet ports;

a water jacket in the internal engine, the water jacked connected between one of said inlet ports and one of said outlet ports;

a heater core for a heater in a passenger compartment, the heater core connected between one of said inlet ports and one of said outlet ports;

a degas bottle to capture and retain gases entrapped in the coolant, the degas bottle connected between one of said inlet ports and one of said outlet ports; and a heat exchanger for heating and cooling lubricating oil, the heat exchanger connected between one of said inlet ports and one of said outlet ports, wherein the multifunction valve interconnects the engine and cooling system components and operates to permit and inhibit flows of coolant as necessary for thermal management of the engine.

2. The circulating coolant cooling system of claim 1, wherein each plate of the multifunction valve is operated by a wax motor.

3. The circulating coolant cooling system of claim 2, wherein each wax motor further includes an electric heater to permit the operation of the wax motors to be overridden electrically.

4. The circulating coolant system of claim 1, wherein the operator includes an electric motor driving a threaded shaft.

5. The circulating coolant cooling system of claim 1, wherein the pump is sized to output substantially 2.75 liters per second at a rotational speed of 7700 RPM.

6. The circulating coolant cooling system of claim 1, further including an EGR valve cooler connected between one of the inlet ports and the outlet ports.

7. The circulating coolant cooling system of claim 1, wherein the valve blocks the flow of coolant through the heater core to increase flow through the radiator when a predetermined coolant temperature is exceeded.

8. The circulating coolant cooling system of claim 1, wherein the valve modulates the flow of coolant to the radiator and the engine water jacket to a variety of different flow rates ranging from zero flow to maximum flow capacity of the pump.

9. The circulating coolant cooling system of claim 1, wherein the valve increases a flow of coolant to the heat exchanger when a predetermined lubricating oil temperature is exceeded.

10. A circulating coolant cooling system for an internal combustion engine, comprising:

a multifunction valve having a plurality of inlet ports and outlet ports, a first moveable plate, a second moveable plate, and an operator for moving the plates to selectively open and close passageways interconnecting the inlet and outlet ports;

a radiator connected between one of said inlet ports and one of said outlet ports;

a pump for pumping coolant, the pump connected between one of said inlet ports and one of said out ports;

a water jacket in the engine, the water jacket connected between one of said inlet ports and one of said outlet ports; and a heater core for a heater in a passenger compartment, the heater core connected between one of said inlet ports and one of said outlet ports, wherein the multifunction valve is operable to modulate a flow of coolant through the heater core ranging from no flow to a maximum flow capacity of the pump.

11. The circulating coolant cooling system of claim 10, wherein the valve blocks the flow of coolant to the radiator when the heater core receives the maximum flow capacity of the pump.

12. The circulating coolant cooling system of claim 10, wherein the valve blocks the flow of coolant through the heater core to increase flow through the radiator when a predetermined coolant temperature is exceeded.

13. The circulating coolant system of claim 10, wherein the valve modulates the flow of coolant to the radiator, the cylinder head water jacket and the engine block water jacket.

14. The circulating coolant cooling system of claim 13, wherein the modulated flow through the radiator is controllable through a range of no flow to a maximum pump flow.

15. The circulating coolant cooling system of claim 10, further including an EGR valve cooler connected between one of the inlet ports and the outlet ports.

16. A circulating coolant cooling system for an internal combustion engine, comprising:

a multifunction valve having a plurality of inlet ports and outlet ports, a first moveable plate, a second moveable plate, and an operator for moving the plates to selectively open and close passageways interconnecting the inlet and outlet ports, the first moveable plate selectively restricting and unrestricting fluid flow through a first one of the plurality of inlet ports and first and second ones of the plurality of outlet ports, the second moveable plate selectively restricting and unrestricting fluid flow through second and third ones of the plurality of inlet ports;

a radiator connected between one of said inlet ports and one of said outlet ports;

a pump for pumping coolant, the pump connected between one of said inlet ports and one of said outlet ports;

a water jacket in the engine, the water jacket connected between one of said inlet ports and one of said outlet ports;

a heater core for a heater in a passenger compartment, the heater core connected between one of said inlet ports and one of said outlet ports;

a degas bottle to capture and retain gases entrapped in the coolant, the degas bottle connected between one of said inlet ports and one of said outlet ports; and an EGR valve cooler connected between one of the inlet ports and outlet ports.

17. The circulating coolant cooling system of claim 16, wherein the operator includes an electric motor.

18. The circulating coolant cooling system of claim 16, wherein the valve blocks the flow of coolant through the heater core to increase flow through the radiator when a predetermined coolant temperature is exceeded.

19. The circulating coolant cooling system of claim 16, wherein the valve modulates the flow of coolant to the radiator and the engine water jacket to a variety of different flow rates ranging from zero flow to a maximum flow capacity of the pump.

* * * * *